United States Patent [19]

Golden

[11] 4,199,618

[45] Apr. 22, 1980

[54] HIDDEN ENTRY SYSTEM

[75] Inventor: Ronald Golden, Mt. Prospect, Ill.

[73] Assignee: Champion International Corporation, Stamford, Conn.

[21] Appl. No.: 609,612

[22] Filed: Sep. 2, 1975

[51] Int. Cl.[2] ..... B41M 5/16; B41M 5/18; B41M 5/20

[52] U.S. Cl. ..... 427/145; 427/261

[58] Field of Search ..... 427/445, 145, 261

[56] References Cited

U.S. PATENT DOCUMENTS

| | | | |
|---|---|---|---|
| 2,695,245 | 11/1954 | Compton | 117/15 |
| 2,777,780 | 1/1957 | Cormack et al. | 427/261 |
| 2,981,733 | 4/1961 | Kranz | 106/22 X |
| 2,981,738 | 4/1961 | Kranz | 106/19 |
| 3,725,104 | 4/1973 | Fraik | 427/56 |
| 3,809,668 | 5/1974 | Yarian | 106/240 X |
| 3,821,010 | 6/1974 | Vincent et al. | 428/307 |
| 3,952,117 | 4/1976 | Miyamoto | 427/261 |

*Primary Examiner*—Bernard D. Pianalto

*Attorney, Agent, or Firm*—Roylance, Abrams, Berdo & Farley

[57] ABSTRACT

Hidden entries are provided on a receptor sheet by applying the desired intelligence to the sheet with a chemical densensitizing agent capable of preventing the formation of a visible image on the receptor sheet when the sheet is contacted with a mark-producing agent. The resulting visible image is provided in the form of a negative wherein the background of the visible image is provided by the mark-forming agent, while the foreground of the visible image is the densensitized portion of the sheet. The mark-forming system comprises a chromogenic composition which is applied to the surface of the receptor sheet adjacent the desensitized portion thereof. The coreactant for the chromogen may either be present on the receptor sheet prior to providing the hidden image thereon by means of a chemical desensitizer, or may be admixed with the chromogen prior to application thereof to the surface of the sheet.

18 Claims, No Drawings

HIDDEN ENTRY SYSTEM

This invention relates to the production of hidden entries. More particularly, this invention relates to the production of a hidden or latent image which may be thereafter converted into a visible image in order reveal stored information previously invisible to the naked eye.

Hidden entry technology has been applied to many diverse fields including education wherein paper-based products are employed as teaching devices wherein information is hidden from view until a later time, which information may comprise the answer to tests in the case of instructional material, or may take the form of educational toys or games wherein a character or symbol is hidden until later revealed when desired. Such systems have been described in various U.S. patents including U.S. Pat. No. 3,363,336 to Skinner; U.S. Pat. No. 3,682,673 to Manske and U.S. Pat. No. 3,725,104 to Fralk, et al.

The various problems involved in the production of hidden entry systems include the difficulty in providing a truly invisible image, which can be made legible at a later time. Thus, many of the systems previously proposed involve the provision of a latent or hidden image which is invisible, but is poorly legible upon development. Still other problems involved in the production of such systems include the difficulty in obtaining a simple development system which is easily duplicated.

Thus, certain of the previously proposed systems involve the provision of a hidden image by reacting a metal salt with a coreactant; however, such systems can have the disadvantage that the metal salts that are employed are usually colored in nature and thus impart various degrees of coloration to the substrate. Still other systems involve the use of heat in a thermal process in order to develop the latent image.

Surprisingly, it has been discovered that a truly invisible hidden image can be provided which can be easily rendered highly legible or readable without the need for heat for development. It has been discovered that a hidden entry system can be provided by forming the hidden image on the surface of a receptor sheet by contacting a predetermined, selected portion of the surface of the receptor sheet with a chemical desensitizing agent that is capable of preventing the formation of a visible image on the receptor sheet when the surface of the receptor sheet is later contacted with a chromogenic composition and an electron-acceptor material capable of forming a visible color upon contact with a chromogenic composition. The hidden image is thereafter developed by contacting at least a portion of the surface of the receptor sheet adjacent the hidden image with with a chromogenic composition, thereby providing a colored marking upon reaction with the electron-acceptor and converting the hidden image into a negative, visible image, wherein the mark-forming composition and desensitized portion of the surface of the receptor sheet combine to form a visible image, wherein the background of the visible image is formed by the mark-forming composition and the foreground of the visible image is formed by the desensitized, selected portion of the receptor sheet.

According to one embodiment of the present invention, the electron-acceptor material is provided as a coating on the surface of the receptor sheet prior to application of the desensitizing agent. Thus, when the chromogenic composition is applied to the portions of the surface of the receptor sheet adjacent the desensitized portion, a visible colored mark is provided in such adjacent portions, and the desensitized portion of the surface becomes visible and provides previously stored, hidden information. Thus, the desensitized portion of the surface, which provides the hidden image, becomes the foreground of the hidden character, while the colored marking provided by the reaction of the chromogen with the electron-acceptor material provides the colored background of the previously hidden character or image.

According to another embodiment of the present invention, the chromogenic composition and the electron-acceptor composition are applied as a mixture to the surface of the receptor sheet adjacent the hidden image. According to this embodiment of the present invention, the chromogenic composition and the electron-acceptor material are provided in a solvent, which permits the mark-forming composition to be easily applied to the surface of the receptor sheet. Thus, the chromogenic compound and the electron-acceptor material may be prereacted to form a colored, mark-forming composition which may be applied with a writing instrument for example, or may be sprayed or otherwise applied in bulk over the surface of the receptor sheet to reveal the previously hidden image.

According to still another embodiment of the present invention, the chromogenic composition and the electron-acceptor material may be provided in an admixture with a volatile solvent which prevents the chromogenic composition from reacting with the electron-acceptor material until the solvent is removed. Thus, the mark-forming composition of this embodiment is colorless until applied to the surface of the receptor sheet, whereupon the solvent evaporates and the chromogenic composition and electron-acceptor material are thereupon permitted to react and form a visible image.

The chromogenic composition and electron-acceptor components of the present invention may comprise materials that are well-known to those skilled in the art of carbonless copy paper production, wherein colorless dye-forming materials or chromogens are isolated from electron-acceptor materials of the Lewis acid type until they are permitted to come in contact and form a colored marking.

Accordingly, suitable chromogenic compositions include those previously described, for example, in U.S. Pat. Nos. 2,981,733; 2,981,738; 3,819,396; 3,821,010; 3,875,074; and the like.

Thus, suitable chromogenic compounds include the leuco dyes which are capable of reversably forming a colored, carbonium ion species such as those having the general formula

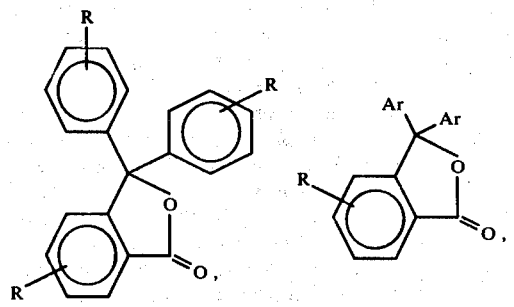

-continued

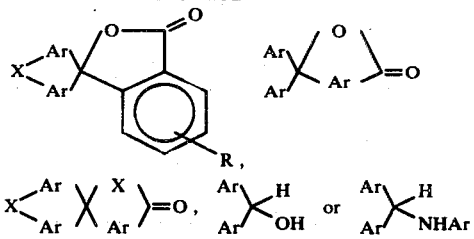

wherein Ar is an aromatic nucleus capable of supporting a positive charge; R is a group capable of stabilizing a positive charge, and X is a heteroatom such as oxygen or nitrogen.

Specific examples of suitable leuco dyes include: leuco triarylmethane dyes such as 3,3-bis (p-dimethylaminophenyl)-6-dimethylaminophthalide (crystal violet lactone), 3,3-bis (p-dimethylaminophenyl) phthalide, (malachite green lactone), 3-(p-dimethylaminophenyl)-3-(1,2-dimethylinodol-3-yl) phthalide, 3-(p-dimethylaminophenyl)-3-(2-phenylindol-3-yl) phthalide, 3,3-bis (1,2-dimethylindol-3-yl)-5-dimethylaminophthalide, 3,3-bis (1,2-dimethylindol-3-yl)-6-dimethylaminophthalide, 3,3-bis (9-ethylcarbazol-3-yl)-5-dimethylaminophthalide, 3-p-dimethylaminophenyl-3-(1-methylpyrrol-2-yl)-6-dimethylaminophthalide, 7-(1-ethyl-2-methylindol-3-yl)-7-(3-ethoxydiethylaminophen-4-yl)-5,7-dihydrofuro[3,4-b]pyrazin-5-one, 3-(p-dimethylaminophenyl)-3-(2-methylindol-3-yl)-4,5,6,7-tetrachlorophthalide, 7-(1-ethyl-2-methylindol-3-yl)-7-(3-methyldimethylaminophen-4-yl)-5,7-dihydrofuro[3,4-b]pyridin-7-one, 3-(4-diethylaminophenyl)-3-(1,2-diethylindol-3-yl) napthalide; diphenylmethane compounds such as leuco auramine, N-halophenyl leuco auramine, 4,4'-bis-dimethylaminobenzhydrine benzyl ether; xanthene compounds such as rhodamine B lactam, rhodamine B-(p-chloroanilino) lactam, 7-dimethylamino-2-methoxyfluoran, 2,2'-iminobis (6-dimethylaminofluoran), 3-diethylamino-7-(N'-paramethoxyphenyl) piperazinofluoran, 2'-[N-(carbethoxymethyl-)amino]-6'-diethylaminofluoran, 6'-diethylamino-2'[N-(N,N'-dimethylcarbamoyl)methylamino]fluoran, 6'-diethylamino-2'-(p-nitrobenzenesulfonamino) fluoran; spiropyran and benzopyran compounds such as 3,3'-dichlorospiro-dinapthopyran, 3-benzyl-spiro-dinapthopyran, 3-propyl-spiro-dibenzopyran, 2-(2,5-dichloroanilino)-2-(p-methoxyphenyl)-2(H) benzopyran, 5-dimethylaminospiro-[isofuran-1(3H)-2'(2H)-1-benzopyran-3-one]; acridan dyes such as 9-(p-dimethylaminophthalyl-3)-10-methylacridan and the like.

The foregoing chormogenic compounds are only given for purposes of illustration, since any chormogenic compound which is capable of reacting with an electron-acceptor material may be employed. However, it is preferred to use those chromogenic compositions which react fairly rapidly with the electron-acceptor materials to form a visible image, if the reaction is to take place on the receptor sheet at the time of use, as opposed to utilizing the premixed, colored mark-forming composition embodiment of the present invention.

As previously indicated, the coreactant for the chromogenic composition is an electron-acceptor material, generally of the Lewis acid type. Such materials are also well-known in the art of carbonless copy paper and include an acid-reactive clay or minerals, such as calcined kaolin, atapulgite, bentonite, silica, alumina or the like. Still further electron-acceptor materials include phenols, phenol formaldehyde novolaks, metal salts of phenols, metal salts of phenol formaldehyde novolaks, particularly the zinc and ferric salts, carboxylic acids, metal salts of carboxylic acids, particularly the zinc and ferric salts of carboxylic acids and other oil-soluble metal salts.

Thus, any suitable electron-acceptor coreactant material may be employed, so long as a strong color reaction is produced when reacted with the chromogenic composition. Additionally, in the case of those electron-acceptor materials that are admixed with the chromogenic composition according to certain embodiments of the present invention, both the electron-acceptor material and the chromogenic composition must be co-soluble in a suitable solvent.

Suitable amounts of the coreactants include between about 10 and about 0.1 part of chromogen per part of electron-acceptor materials, preferably between about 1 and about 0.5 part per part.

The mark-forming composition of the present invention does not require the use of heat for development of the hidden image, but such materials are capable of reacting under ambient conditions.

A conventional CF sheet as used in the production of carbonless copy paper may be used as the receptor sheet of the present invention, wherein the electron-acceptor material, such as acidic clay, is coated onto a substrate, such as paper. Such paper can then be treated with the desensitizing composition to form the particular character, symbol or information in general that is desired to be stored until a subsequent time, and at such later date at which time it is desired to develop the hidden image, the chromogen can then be applied to the surface of the CF sheet at least at the portions thereof adjacent the hidden image by any suitable means including the application of the chromogen by a felt applicator, roller, or vaporization of the chromogen onto the surface of the receptor sheet.

Any suitable desensitizing agent can be utilized for desensitizing or deactivating the chromogen or the electron-acceptor material. Such desensitizing agents are well-known to the art of carbonless copy paper, and include organic ammonium compounds, such as those described in U.S. Pat. No. 2,777,780 to Cormack, et al. Likewise, material such as the citric acid and the like disclosed in U.S. Pat. No. 3,364,052 to Martino may be employed. Still other desensitizing agents include those described in U.S. Pat. No. 3,809,668 to Yarian including ethylenediaminetetraacetic acid (EDTA) may be employed. Other suitable desensitizing agents for use in the present invention include those provided by nonvolatile, polyoxygenated compound alone or in combination with a complexing agent or strong chelating agent.

Suitable polyoxygenated compounds include those possessing either polyhydroxy groups or polyether groups. Such compounds include those compounds, therefore, in which the oxygen exists either as hydroxy functional groups or ether functional groups, including polyethylene glycol; polyethylene oxide; polyethylene oxide-polypropylene oxide copolymers; polypropylene oxide; glycols; polyglycols; glycol ethers; glycol esters; polyglycol ethers and esters; pentaerythritol, sorbital, and their derivatives; and compounds containing polyethylene oxide groups, in general, such as nonionic surfactants. Accordingly, the only requirements for the polyoxygenated compound is that it contain oxygen as ether or hydroxy functional groups, and that it not be volatile or fugative enough to be lost from the CF coating. Thus, the polyoxygenated compounds of the present invention must have a lower volatility than glycerin or ethylene glycol, for example.

Such polyoxygenated compounds, such as the polyethylene oxides and polyethylene glycols are commercially available from Union Carbide under the trade name "Polyox" and BASF Wyandotte under the trade name "Pluracol". Similarly, the polyethylene glycols, some of which are capped by methoxy groups, are available from Union Carbide under the trade name "Carbowax", while polyethylene oxide-polypropylene oxide block copolymers are available under the trade names "Pluronic", "Tetronic" and "Pluronic R", surfactants available from BASF Wyandotte. Still other surfactants, which may be nonionic, include ethoxylated nonylphenol, alcohol ethoxylates, and ethoxylated surfactants containing anionic groups. Likewise, humectants, such as sorbitol, pentaerythritol, and low molecular weight polyglycols, such as tetraethylene glycol, may be employed. Such polyoxygenated compounds, which may be employed in the present invention, are described throughout the literature, and include, for example, U.S. Pat. No. 2,674,619 to Lundsted, which describes polyoxyalkaline compounds of the type contemplated, and, and article by Stanton in "Soap and Chemical Specialties", 1957, Vol. 33, No. 6, pp. 47 et sequa.

The polyoxygenated compound is used alone or in combination with a complexing agent, which is a strong chelating agent. The expression "strong chelating agent" as used herein means those complexing or sequestering agents having a dissociation constant with metals, such as iron, zinc or cobalt of less than $10^{-5}$.

Suitable complexing agents include ethylenediamenetetraacetic acid tetrasodium salt (EDTA-4Na), sodium citrate, the pentasodium salt of diethylenetriamene-pentaacetic acid (DTPA-5Na), which is commercially available from Mona Industries Inc. under the trade name "Monaquest CAI-80", the trisodium salt of hydroxyethylene-diaminetetraacetic acid (available as "Monaquest ICA-120"); the monosodium salt of dihydroxyethylglycine (available as "Monoaquest CI"); nitrolotriacetic acid trisodium salt (commercially available from Dow Chemical as "Versene NTA") and the like. The preferred group of sequestering agents includes the EDTA and its derivatives as described in U.S. Pat. No. 3,809,668 and having the formula

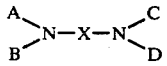

wherein

X is a divalent aliphatic or cycloaliphatic radical, preferably an alkylene radical of the formula $$-CH_2CH_2- \text{ or } -CH_2CH_2CH_2-$$

or a cyclic radical, such as cyclopentane, cyclohexane, etc., wherein the nitrogens are substituted 1,2- or 1,3-, A, B, C, and D are selected from the following group of substituents:

hydrogen, an aliphatic or cycloaliphatic group, $$-CH_2-COOH$$

$$-CH_2-COOR$$

(where R is aliphatic, preferably a lower alkyl group such as methyl, ethyl, propyl, isopropyl, or butyl, optimum results being obtained with methyl), and

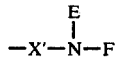

where X' is similar to X, E and F are similar to A, B, C, and D; E or F can therefore be another —X—N(E)(F) unit, such that structures of the following type are formed:

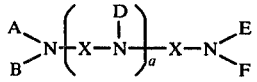

where a is 0, 1, 2, 3, 4 or other small integer. A, B, C, and D must comprise at least one $-CH_2-COOH$ or $-CH_2-COOR$ group.

The description and production of such compounds is defined in U.S. Pat. No. 3,809,668, as well as U.S. Pat. Nos. 2,901,335; 2,794,000; 2,428,353; and 3,234,173; the disclosure of EDTA and its derivatives as disclosed therein being incorporated herein by reference.

As previously indicated, the preferred sequestering agent is ethylenediaminetetraacetic acid tetrasodium salt.

Any suitable concentration of polyoxygenated compound and complexing agent may be employed. Suitable amounts include between about 10 and about 0.1 parts by weight of polyoxygenated compound per part by weight of complexing agent, preferably between about 3 and about 1 parts by weight of complexing agent may be employed.

As previously indicated, the chromogenic composition and the electron-acceptor material may be used in combination for application to the receptor sheet to which the desensitizing composition has been previously applied. In such instance, the receptor sheet may be any substrate, such as ordinary bond paper, synthetic paper, plastic film, or the like, and need not be previously treated with any special additive, such as an electron-acceptor material.

Thus, the chromogenic composition and the electron-acceptor material may be prereacted in a non-reactive solvent, such as toluene, xylene, chlorinated hydrocarbons or the like, which solvent may be either volatile or non-volatile. In such instance, the chromogenic composition is prereacted with the electron-acceptor material and used in the form of an ink. When it is applied to the receptor sheet, a colored mark will appear on the receptor sheet at every portion thereof except where the desensitizing agent has been applied. Additionally, other additives may be employed, such as viscosity modifiers, including resinous materials that are conventionally added to inks, in order to provide the optimum ease of application. The only consideration here is that the additives to the mark-forming composition must not interfere with color formation.

According to another embodiment of the present invention, a reactive solvent is employed in admixture with the chromogenic material and the electron-acceptor so as to prevent reaction until the solvent evaporates. In this embodiment, reactive solvents, including those containing oxygen or nitrogen are employed, which solvents must also be volatile at ambient temperatures, so that upon application of the mark-forming composition, the solvent will vaporize and no longer impede or prevent the reaction of the chromogenic composition with the electron-acceptor material. Suitable reactive solvents include acetone, ethyl acetate, methanol, ethanol, methylethyl ketone and the like. Of course, non-volatile, reactive solvents could be employed, if it were disired to employ a thermal system wherein the solvent is heated in order to develop the latent or hidden image. However, it is preferred to use reactive solvent that is volatile at ambient temperatures.

The following examples further illustrate the present invention. The percentages are by weight unless otherwise indicated.

EXAMPLE 1

An acid reactive receptor sheet is prepared by coating a composition containing 100 parts by weight of AA Silton clay (Mizusawa Industrial Chemicals), 300 parts of water, 10 parts of zinc oxide, 1.5 parts of polyphosphate dispersant, 2.5 parts of sodium carboxymethyl cellulose, 40 parts of a styrene butadiene latex adhesive (50 percent solids, Dow 620 latex) and 2.6 parts of 28 percent aqueous ammonia on a paper substrate at a coat weight of about 4 pounds per ream.

A desensitizing solution containing 10 parts by weight of a low molecular methoxy polyethylene glycol (Carbowax 350, Union Carbide) and 90 parts of 95 percent ethanol are used to provide hidden images on the receptor sheet using a rubber stamp applicator. When dried, no trace of the treated areas is visible.

A solution of 3,3-bis(p-dimethyaminophenyl)-p-dimethylaminophthalide (crystal violet lactone) in toluene is applied to the treated area of the receptor sheet with a felt-tip marker, resulting in an intense blue coloration of the surface, with the exception of the areas treated with the polyoxygen desensitizing compound. This area remains colorless, leaving a bright, legible, negative image of the stamped impression.

EXAMPLE 2

An acid reactive receptor sheet is prepared as described in Example 1 and is treated with a desensitizing composition comprising a 10 percent aqueous solution of the tetrasodium salt of ethylenediamine tetraacetic acid in water, using a felt-tip pen. After drying, no trace of the treated areas is visible.

The latent image is developed by applying a solution of leucoauramine in toluene, using a felt roller. An intense blue coloration appears on the surface of the receptor sheet, with the exception of the areas treated with the desensitizing solution, leaving a bright, legible, negative image.

EXAMPLE 3

A narrow piece of finely woven silk cloth is saturated with a low molecular weight polyethylene oxide (Pluracol E 400, BASF Wyandotte) and is used as a typewriter ribbon to type an invisible latent image on a receptor sheet prepared as described in Example 1. A paper sheet coated with microcapsules containing an oily solution of crystal violet lactone is superimposed over the receptor sheet, with the two reactive sides of the sheets in contact. The manifold is passed through a steel-to-steel calender, compressing the sheets, rupturing the microcapsules and transferring the oily leuco dye solution to the receptor sheet. The latent image becomes clearly visible, just as described in Example 1.

EXAMPLE 4

A 10 percent solution of stearyl trimethyl ammonium chloride in 95 percent ethanol is applied to a receptor sheet of the type described in Example 1, using a felt-tip pen, to provide an invisible latent image. A toluene solution of rhodamine B lactone is applied to the receptor sheet with a felt-tip marker to give a bright red coloration except where the sheet had been chemically desensitized, revealing a clearly legible, negative image.

EXAMPLE 5

An acid reactive receptor sheet is prepared using a coating composition comprising kaolin clay, the zinc salt of benzoic acid and polyvinyl alcohol adhesive. Invisible latent images are provided and developed on this substrate, just as described in the previous examples.

EXAMPLE 6

An acid reactive receptor sheet is prepared using a coating composition comprising kaolin clay, the zinc salt of a low molecular weight tert-butylphenol novolak and polyvinyl alcohol adhesive. Invisible latent images are provided and developed on this substrate, just as described in the previous examples.

EXAMPLE 7

An invisible latent image is provided on a plain bond paper substrate using the chemical desensitizing agent described in Example 1. The image is developed using a 10 percent solution of equal parts by weight of crystal violet lactone and a low molecular weight tert-butylphenol novolak in toluene, applied using a felt-tip marker. The co-reactant developing solution is strongly colored and provides an intense blue color on the untreated substrate except on those areas desensitized by the polyoxygen compound, leaving a clearly legible negative image on a dark background.

EXAMPLE 8

A solution of equal parts by weight of the zinc salt of 3,5-diisopropyl-salicylic acid and 3,3-bis-p-dimethylaminophenyl)phthalide (malachite green lactone) in trichloroethane is used to develop invisible latent images as described in Example 7 with similar results.

EXAMPLE 9

A solution of equal parts of a low molecular weight tert-butylphenol novolak and 2-methyl-6-diethylaminofluoran in acetone is used to develop invisible latent images as described in Example 7. In this case the developer solution and marker tip remain completely colorless. However, when the acetone solution is applied to the treated paper substrate, the acetone evaporates, resulting in the rapid formation of a bright red-orange background color on which a negative image corresponding to the desensitized areas appears.

EXAMPLE 10

The processes of Examples 7 to 9 are repeated using substrates other than paper, including synthetic paper (Tyvec, DuPont), wood and plastic film, with similar results.

EXAMPLE 11

An acid reactive receptor sheet is prepared as described in Example 1 and is treated with a desensitizing composition comprising 10 percent solution of a low molecular weight polypropylene glycol dissolved in toluene, using a felt tip pen to provide an invisible latent image. The latent image is developed by applying a one percent solution of crystal violet lactone in toluene.

EXAMPLE 12

A desensitizing composition is prepared from 10 parts of a low molecular weight polyethylene oxide, 10 parts of ethylenediaminetetraacetic acid tetrasodium salt and 150 parts of water. This is applied to the reactive surface of a white commercial carbonless copy paper acid-reactive receptor sheet (Champion Papers Micron II CF bond) and dried to provide a completely invisible latent image.

Subsequently the image is developed by application of a two percent solution of malachite green lactone in toluene, resulting in a bright, legible white image against a blue-green background.

What is claimed is:

1. A method for the production and development of a hidden image on a receptor sheet, which method comprises:

providing a receptor sheet;

forming a hidden image on the surface of said sheet by contacting a predetermined, selected portion of said surface with a chemical desensitizing agent capable of preventing the formation of a visible image on said receptor sheet when said surface of said receptor sheet is contacted with a chromogenic composition and electron-acceptor material capable of forming a visible color upon contact with said chromogenic composition, thereby providing stored information in the form of a hidden, desensitized, latent image on said surface at the desensitized portion thereof;

thereafter developing said hidden image by contacting the surface of said receptor sheet adjacent said hidden image with a mark-forming composition comprising at least said chromogenic composition so as to convert said hidden image substantially entirely into a negative, visible image, said chromogenic composition reacting with said electron-acceptor material to provide a colored marking on said receptor sheet and thereby converting said hidden image into a negative, visible, image wherein said mark-forming composition and said desensitized portion of said surface combine to form said visible image wherein the background of said visible image is formed by said mark-forming composition and the foreground of said visible image is formed by said desensitized, selected portion.

2. The method of claim 1 wherein said mark-forming composition comprises a solvent and an electron-acceptor material.

3. The method of claim 2 wherein said solvent is volatile and maintains said mark-forming composition in a substantially colorless condition until said solvent evaporates upon application of said mark-forming composition to said receptor sheet.

4. The method of claim 2 wherein said chromogenic composition and said electron-acceptor material have been prereacted prior to application of said mark-forming composition to said receptor sheet.

5. The method of claim 1 wherein said receptor sheet is provided with a coating comprising an electron-acceptor material prior to application of said chemical desensitizing agent.

6. The method of claim 1 wherein said chemical desensitizing agent is a combination of a non-volatile polyoxygenated compound and a strong chelating agent.

7. A method for producing and developing a hidden image on a receptor sheet, which method comprises:

providing a receptor sheet;

forming a hidden image on the surface of said sheet by contacting a predetermined, selected portion of said surface with a chemical desensitizing agent capable of preventing the formation of a visible image on said receptor sheet when said surface of said receptor sheet is contacted with a mark-forming composition, thereby providing stored information in the form of a hidden, desensitized, latent image on said surface at the desensitized portion thereof;

said mark-forming composition comprising, in combination, a chromogenic composition and an electron-acceptor material capable of forming a colored mark upon contact with said chromogenic composition; thereafter contacting the surface of said receptor sheet adjacent said hidden image with said mark-forming composition, so as to convert said hidden image substantially in its entirety into a negative, visible image wherein said mark-forming composition and said desensitized portion of said surface combine to form a visible image wherein the background of said visible image is formed by said mark-forming composition and the foreground of said visible image is formed by said desensitized selected portion.

8. A method for providing and developing a hidden image on a receptor sheet, which method comprises:

providing a receptor sheet having at least a portion of its surface coated with an electron-acceptor material capable of forming a visible color upon contact with a chromogenic compound;

forming a hidden image on said surface coating by contacting a predetermined, selected portion of said surface coating with a chemical desensitizing agent capable of preventing the formation of a visible image on said receptor sheet when said surface of said receptor sheet is contacted with said chromogenic compound, thereby providing stored information in the form of a hidden, desensitized selected image on said surface coating;

thereafter contacting portions of said surface coated with said electron-acceptor material which are directly adjacent said hidden image with a chromogenic compound capable of reacting with said electron-acceptor material and thereby forming a colored marking so as to convert said hidden image substantially in its entirety into a negative, visible image, said colored marking and said desensitized, selected portion combining to form said visible image wherein the background of said visible image is formed by said colored marking and the foreground of said visible image is formed by said desensitized, selected portion.

9. The method of claim 1 wherein said chemical desensitizing agent is a non-volatile polyoxygenated compound.

10. The method of claim 9 wherein said polyoxygenated compound is polypropylene glycol.

11. The method of claim 8 wherein said desensitizing agent comprises polyethylene oxide and ethylenediaminetetraacetic acid.

12. The method for the production of a hidden image on a receptor sheet, which method comprises:

providing a receptor sheet;

providing a desensitizing substrate capable of use as a typewriter ribbon, said desensitizing substrate bearing a chemical desensitizing agent capable of preventing the formation of a visible image on said receptor sheet when said surface of said receptor sheet is contacted with a chromogenic composition and an electron-acceptor material capable of forming a visible color upon contact with said chromogenic composition, said desensitizing agent being disposed on said desensitizing substrate in a manner such that it can be physically transferred to said receptor sheet by the application of local pressure;

superimposing said receptor sheet and said desensitizing substrate;

and transferring predetermined, selected portions of said desensitizing agent from said desensitizing substrate to said receptor sheet by application of localized pressure thereby providing stored information in the form of a hidden, desensitized, latent image on selected portions of the surface of said receptor sheet at the desensitized portions thereof.

13. The method of claim 12 wherein said hidden image is thereafter developed by contacting the surface of said receptor sheet adjacent said desensitized portions with a mark-forming composition, said mark-forming composition providing a colored marking resulting from the reaction of a chromogenic composition with an electron-acceptor material and thereby converting said hidden image into a negative, visible image wherein said mark-forming composition and said desensitized portion of said surface combine to form said visible image wherein the background of said visible image is formed by said mark-forming composition and the foreground of said visible image is formed by said desensitized selected portion.

14. The method of claim 12 wherein said desensitizing agent is a low molecular weight polyethylene oxide.

15. The method of claim 1 wherein said mark-forming composition is contacted with the surface of said receptor sheet by means of a roller.

16. The method of claim 1 wherein said mark-forming composition is contacted with the surface of said receptor sheet by means of a felt applicator.

17. The method of claim 7 wherein said mark-forming composition is contacted with the surface of said receptor sheet by means of a roller.

18. The method of claim 7 wherein said mark-forming composition is contacted with the surface of said receptor sheet by means of a felt applicator.

* * * * *